US010221753B2

(12) United States Patent
Sakamoto et al.

(10) Patent No.: US 10,221,753 B2
(45) Date of Patent: Mar. 5, 2019

(54) VEHICLE

(71) Applicant: SUBARU CORPORATION, Tokyo (JP)

(72) Inventors: Shigeru Sakamoto, Tokyo (JP); Itsumi Suda, Tokyo (JP); Yusuke Yamauchi, Tokyo (JP); Yutaka Takahashi, Tokyo (JP); Yoshiyuki Kanesaka, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/483,921

(22) Filed: Apr. 10, 2017

(65) Prior Publication Data

US 2017/0314454 A1 Nov. 2, 2017

(30) Foreign Application Priority Data

Apr. 28, 2016 (JP) ..... 2016-091789

(51) Int. Cl.
*F01P 7/16* (2006.01)
*F01P 3/02* (2006.01)
*F01P 7/14* (2006.01)

(52) U.S. Cl.
CPC ..... *F01P 7/16* (2013.01); *F01P 3/02* (2013.01); *F01P 2003/024* (2013.01); *F01P 2003/027* (2013.01); *F01P 2007/146* (2013.01)

(58) Field of Classification Search
CPC ..... F01P 7/16; F01P 3/02; F01P 2003/024
See application file for complete search history.

(56) References Cited

U.S. PATENT DOCUMENTS 4,381,736 A * 5/1983 Hirayama ..... F01P 7/164 123/41.1
2002/0050251 A1* 5/2002 Takahashi ..... F01P 7/048 123/41.1

(Continued)

FOREIGN PATENT DOCUMENTS

CN 104508274 A 4/2015
JP UM S62-078322 A 5/1987

(Continued)

OTHER PUBLICATIONS

Japanese Office Action dated Apr. 3, 2018 in corresponding Patent Application No. 2016-091789 with an English translation thereof.

(Continued)

*Primary Examiner* — Jacob Amick
*Assistant Examiner* — Charles Brauch
(74) *Attorney, Agent, or Firm* — McGinn I.P. Law Group, PLLC.

(57) ABSTRACT

A vehicle includes a radiator, a bypass passage, a first valve, a second valve, and a controller. Cooling water is circulated through the radiator independently of a cylinder block and a cylinder head of an engine. The radiator cools the cooling water. The cooling water is circulated through the bypass passage while bypassing the radiator. The first valve switches between an open state in which cooling water is circulated through the cylinder block and a closed state in which cooling water is not circulated through the cylinder block. The second valve receives cooling water circulated through the cylinder head and cooling water circulated through the cylinder block via the first valve. The second valve uses an intermediate opening to adjust a flow rate of cooling water circulated through the radiator and the bypass passage. The controller controls opening and closing of the first valve and the opening of the second valve.

11 Claims, 13 Drawing Sheets

(56) References Cited

U.S. PATENT DOCUMENTS

| | | | | |
|---|---|---|---|---|
| 2013/0255604 | A1* | 10/2013 | Rollinger | F01P 7/048 123/41.15 |
| 2014/0130481 | A1* | 5/2014 | Eager | F02D 41/0245 60/274 |
| 2014/0326198 | A1* | 11/2014 | Kaneda | F01P 3/20 123/41.08 |
| 2014/0331978 | A1* | 11/2014 | Goetzke | F02M 25/0749 123/568.12 |
| 2014/0345547 | A1* | 11/2014 | Lee | F01P 7/165 123/41.1 |
| 2015/0144078 | A1 | 5/2015 | Hutchins | |

FOREIGN PATENT DOCUMENTS

| | | | |
|---|---|---|---|
| JP | 2002-266640 | A | 9/2002 |
| JP | 2004-324459 | A | 11/2004 |
| JP | 2006-242070 | A | 9/2006 |
| JP | 2011-226373 | A | 11/2011 |

OTHER PUBLICATIONS

Chinese Office Action dated Dec. 11, 2018, in corresponding Chinese Patent Application No. 201710217034.

* cited by examiner

VEHICLE

CROSS-REFERENCE TO RELATED APPLICATIONS

The present application claims priority from Japanese Patent Application No. 2016-091789 filed on Apr. 28, 201, the entire contents of which are hereby incorporated by reference.

BACKGROUND

1. Technical Field

The present invention relates to a vehicle through which cooling water is circulated.

2. Related Art

There has been proposed a vehicle in which a passage through which cooling water is circulated independently of a cylinder block and a cylinder head is provided and in which a passage through which the cooling water is circulated to a radiator and a bypass passage through which the cooling water is circulated in such a manner as to bypass the radiator are coupled to each other with a thermostat valve therebetween (for instance, Japanese Unexamined Patent Application Publication (JP-A) No. 2004-324459).

However, the vehicle disclosed in JP-A No. 2004-324459 has the thermostat valve that switches between open and closed states according to the temperature of the cooling water. For this reason, even if cooling water temperature rapidly rises due to engine operation under, for instance, a heavy load, there is a possibility that the cooling water may not circulated through the radiator in a timely manner, which may prevent the cooling water from being cooled promptly.

SUMMARY OF THE INVENTION

It is desirable to provide a vehicle that enables the effective warming and cooling of the components of the vehicle.

A first aspect of the present invention provides a vehicle that includes a radiator through which cooling water is circulated independently of a cylinder block and a cylinder head of an engine and which cools the cooling water, a bypass passage through which the cooling water is circulated in such a manner as to bypass the radiator, a first valve that is switchable between an open state in which the cooling water is circulated through the cylinder block and a closed state in which the cooling water is not circulated through the cylinder block, a second valve that receives the cooling water that has been circulated through the cylinder head and the cooling water that has been circulated through the cylinder block via the first valve, and through the use of an intermediate opening, adjusts a flow rate of the cooling water that is to be circulated through the radiator and the bypass passage, and a controller that controls opening and closing of the first valve and an opening of the second valve.

The controller may control the opening of the second valve based on an engine speed, an engine load, and the temperature of the cooling water that has been circulated through the cylinder head.

The controller may correct the opening of the second valve based on a temperature of the cooling water that has been circulated through the cylinder block and a temperature of the cooling water that has been discharged from a water pump.

The vehicle may further include a thermostat valve that is switchable between an open state in which the cooling water is circulated through a transmission independently of the cylinder block and the cylinder head and a closed state in which the cooling water is not circulated through the transmission.

The vehicle may further include a water delivery pipe through which the cooling water that has been circulated from the second valve and the cooling water that has been circulated from the transmission via the thermostat are discharged into the bypass passage.

BRIEF DESCRIPTION OF THE DRAWINGS

FIG. 9 is a diagram illustrating how cooling water is circulated when a heater is on.

FIG. 10 is a diagram illustrating how cooling water is circulated when a heater is on.

FIG. 11 is a diagram illustrating how cooling water is circulated when a heater is on.

FIG. 12 is a diagram illustrating how cooling water is circulated when a heater is on.

FIG. 13 is a diagram illustrating how cooling water is circulated when a heater is on.

DETAILED DESCRIPTION

Figure 1:
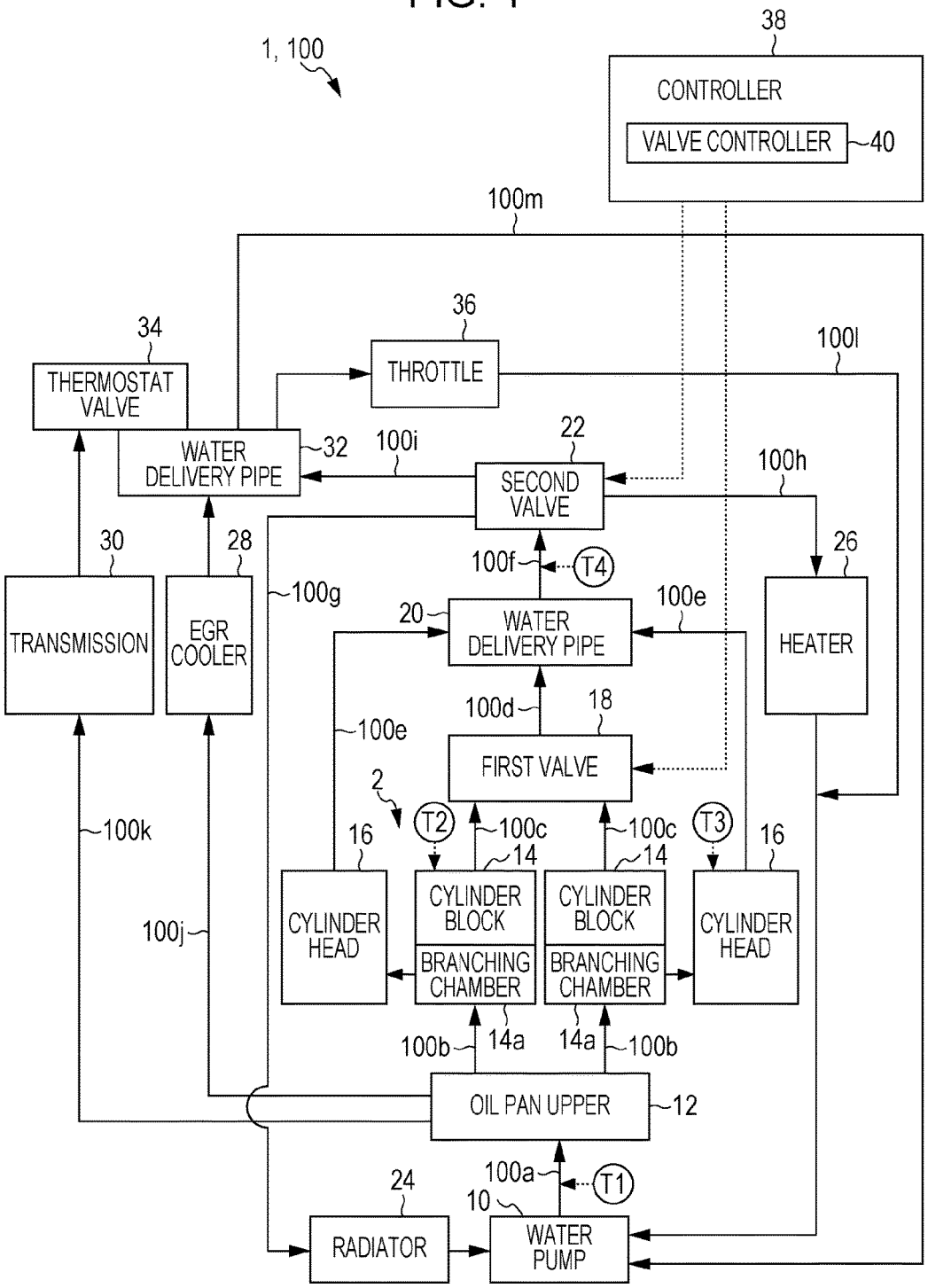
FIG. 1 is a diagram illustrating a configuration of a vehicle.

An example according to the present invention will be described below in detail with reference to the attached drawings. Dimensions, materials, or other numerical values given in such an example are provided to facilitate understanding of the present invention and, unless otherwise specified, will not be construed to limit the present invention. In this description and the attached drawings, components having substantially the same function or configuration are denoted by the same reference numerals and symbols and a description thereof is omitted. In addition, an illustration of components that have no direct relationship with the present invention is omitted.

FIG. 1 is a diagram illustrating a configuration of a vehicle 1. In FIG. 1, cooling water passages 100 are depicted by solid lines, while signal flows are depicted by dashed lines. As illustrated in FIG. 1, the vehicle 1 is provided with a water pump 10, an oil pan upper 12, an engine 2 (a cylinder block 14, a cylinder head 16), a first valve 18, a water delivery pipe 20, a second valve 22, a radiator 24, a heater 26, an EGR cooler 28, a transmission 30, a water delivery pipe 32, a thermostat valve 34, a throttle 36, a controller 38, and temperature sensors T1 through 14. In addition, the vehicle 1 has cooling water that is circulated through these components via the cooling water passages 100 (100*a* through 100*m*).

The water pump 10 has a pump discharge passage 100*a*, a radiator passage 100*g*, a heater passage 100*h*, and a bypass passage 100*m* coupled thereto. The water pump 10 is rotated by the rotary power of the engine 2 and discharges to the pump discharge passage 100*a* the cooling water received from the radiator passage 100*g*, the heater passage 100*h*, and the bypass passage 100*m*.

The oil pan upper 12 has the pump discharge passage 100*a*, a block inflowing passage 100*b*, an EGR passage 100*j*, and a transmission passage 100*k* coupled thereto. The oil pan upper 12 temporarily holds the cooling water received from the water pump 10 via the pump discharge passage 100*a* and discharges the cooling water to the block inflowing passage 100*b*, the EGR passage 100*j*, and the transmission passage 100*k*.

The engine 2 is a so-called horizontally opposed engine provided with a pair of cylinder blocks 14 and a pair of cylinder heads 16 in which the pair of cylinder blocks 14 are disposed so as to oppose each other in the substantially horizontal direction. The driving torque of the engine 2 is transmitted to wheels through the process of speed change in the transmission 30. Each of the cylinder blocks 14 is provided with a branching chamber 14*a* where the cooling water is divided and directed toward the inside of the cylinder block 14 and the inside of the cylinder head 16. Although the pair of cylinder blocks 14 and the pair of cylinder heads 16 are separated from each other in FIG. 1, the pair of cylinder blocks 14 are actually disposed so as to oppose each other and are coupled to the pair of cylinder heads 16, respectively, in an example.

The cylinder block 14 has a block discharge passage 100*c* coupled thereto that is located downstream of the branching chamber 14*a* and into which the cooling water is discharged after being circulated through the cylinder block 14 and, in addition, is coupled to the cylinder head 16 with the branching chamber 14*a* therebetween. The cylinder head 16 has a head passage 100*e* coupled thereto into which the cooling water is discharged after being circulated through the inside of the cylinder head 16.

The first valve 18 has the block discharge passage 100*c* and a valve passage 100*d* coupled thereto and consists of an ON/OFF valve that is switchable between an open state in which the block discharge passage 100*c* and the valve passage 100*d* are in communication with each other and a closed state in which the block discharge passage 100*c* and the valve passage 100*d* are disconnected from each other. The first valve 18, when in the open state, enables the cooling water received from the block discharge passage 100*c* to be discharged into the valve passage 100*d*. On the other hand, the first valve 18, when in the closed state, shuts off the cooling water received from the block discharge passage 100*c*, disabling the discharge of the cooling water into the valve passage 100*d*.

The water delivery pipe 20 has the valve passage 100*d*, the head passage 100*e*, and a second valve inflowing passage 100*f* coupled thereto and discharges the cooling water received from the valve passage 100*d* and the head passage 100*e* into the second valve inflowing passage 100*f*. In other words, the water delivery pipe 20 causes the cooling water circulated through the engine 2 to flow into a second valve 22.

The second valve 22 is a rotary valve having the second valve inflowing passage 100*f*, the radiator passage 100*g*, the heater passage 100*h*, and a water delivery passage 100*i* coupled thereto. Through the rotation of a rotor, the second valve 22 switches among passages (including the radiator passage 100*g*, the heater passage 100*h*, and the water delivery passage 100*i*) to be coupled to the second valve inflowing passage 100*f*, as detailed later.

The radiator 24 is provided along the radiator passage 100*g* and cools the cooling water by releasing cooling water heat to the outside. The heater 26 is provided along the heater passage 100*h* and, when a heater switch (not illustrated) is turned on, releases cooling water heat to a passenger compartment to warm the passenger compartment.

The EGR cooler 28 is provided along the EGR passage 100*j* and cools exhaust gas emitted from the engine 2 along the EGR passage where part of the exhaust gas is returned to an intake passage of the engine 2. The transmission 30 consists of a continuously variable transmission (CVT) and is provided along the transmission passage 100*k* to transmit transmission torque transmitted from the engine 2 to wheels through the process of a stepless speed change.

The water delivery pipe 32 has the water delivery passage 100*i*, the EGR passage 100*j*, a throttle passage 100*l*, and the bypass passage 100*m* coupled thereto and also has the transmission passage 100*k* coupled thereto via the thermostat valve 34. The water delivery pipe 32 discharge to the throttle passage 100*l* and the bypass passage 100*m* the cooling water received from the water delivery passage 100*i*, the EGR passage 100*j*, and the transmission passage 100*k*. The flow rate of the cooling water circulated through the throttle passage 100*l* is much smaller than the flow rate of the cooling water circulated through other passages.

The thermostat valve 34 has the transmission passage 100*k* and the water delivery pipe 32 coupled thereto. The thermostat valve 34 enters an open state in which the transmission passage 100*k* and the water delivery pipe 32 are in communication with each other when the temperature of cooling water within the water delivery pipe 32 is equal to or higher than a predetermined first temperature threshold (for instance, 50 degrees centigrade) and enters a closed state in which the transmission passage 100*k* and the water delivery pipe 32 are disconnected from each other when the temperature of cooling water within the water delivery pipe 32 is lower than the predetermined first temperature threshold.

The throttle 36 is provided along the throttle passage 100*l* joined to the heater passage 100*h* at a point located downstream of the heater 26 and adjusts the amount of air to be supplied to the engine 2 through the adjustment of an opening by an actuator (not illustrated) according to the amount of movement or depression of an accelerator pedal.

The controller 38 consists of a semiconductor integrated circuit that includes a central processing unit (CPU), a ROM where programs are stored, a RAM as a work area, and the like. The controller 38 has the temperature sensors T1 through T4 coupled thereto and controls operation of the water pump 10, the first valve 18 and the second valve 22 based on signals sent from the temperature sensors T1 through 14 and the operating conditions (including an engine speed and an engine load) of the engine 2. Note that the controller 38 derives an engine speed from a signal indicating a crank angle sent from a crank angle sensor (not illustrated) provided on a crankshaft of the engine 2 and, in addition, derives the opening of the throttle 36 as an engine load.

The temperature sensor T1 is provided in the pump discharge passage 100*a* and measures the temperature of the cooling water discharged from the water pump 10. The temperature sensor T2 is provided in the cylinder block 14 and measures the temperature of the cooling water that has run through the inside of the cylinder block 14. The temperature sensor T3 is provided in the cylinder head 16 and measures the temperature of the cooling water that has run through the inside of the cylinder head 16. The temperature sensor 14 is provided in the second valve inflowing passage 100*f* and measures the temperature of the cooling water that has run through the engine 2.

Next, a description of control processing performed by the controller 38 will be provided below. Before the description, the relationship between rotor rotation angle and opening ratio in the second valve 22 will be described below.

Figure 2:
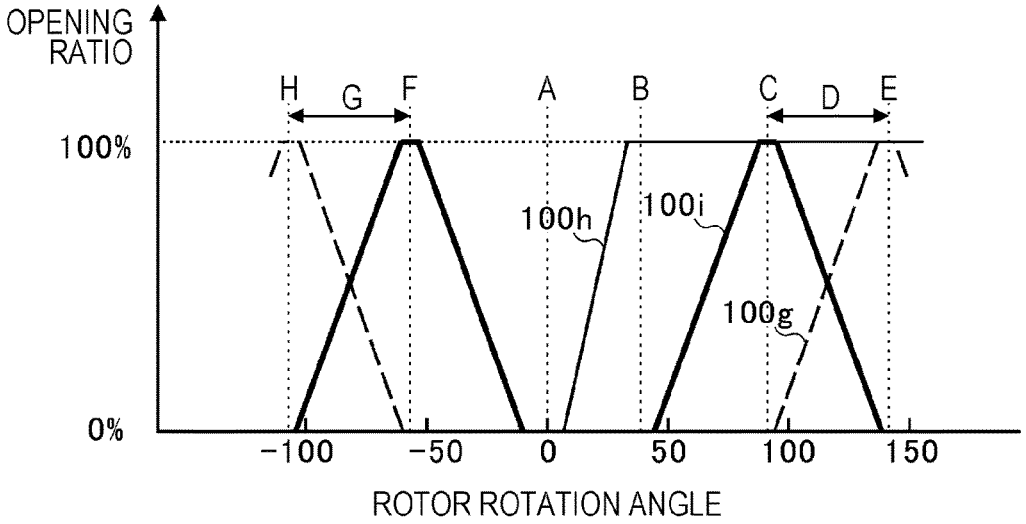
FIG. 2 is a diagram illustrating the relationship between a rotor rotation angle and an opening ratio of a second valve.

FIG. 2 is a diagram illustrating the relationship between a rotor rotation angle and an opening ratio of a second valve. In FIG. 2, the opening ratio for the radiator passage 100*g* is depicted by dashed lines, the opening ratio for the heater passage 100*h* is depicted by thin lines (solid lines), and the opening ratio for the water delivery passage 100*i* is depicted by bold lines (solid lines).

As illustrated in FIG. 2, the second valve 22 has the rotor that is rotatable in the positive and negative directions for a state in which the rotor rotation angle is 0 degrees. When the second valve 22 has the rotor rotation angle of 0 degrees (indicated by "A" in FIG. 2), each of the opening ratios for the radiator passage 100*g*, the heater passage 100*h*, and the water delivery passage 100*i* is 0%, disabling the discharge of the cooling water into each of the radiator passage 100*g*, the heater passage 100*h*, and the water delivery passage 100*i*.

In addition, when the second valve 22 has the rotor rotation angle indicated by "B" in FIG. 2 after the rotor is rotated in the positive direction, the opening ratio for the heater passage 100*h* becomes 100%, enabling the maximum flow of discharge of the cooling water into the heater passage 100*h* only. Moreover, when the second valve 22 has the rotor rotation angle indicated by "C" in FIG. 2 after the rotor is rotated further in the positive direction, the opening ratios for the heater passage 100*h* and the water delivery passage 100*i* become 100%, enabling the discharge of the cooling water into the heater passage 100*h* and the water delivery passage 100*i*. In other words, the rotor rotation angle indicated by "C" in FIG. 2 disables the discharge of the cooling water into the radiator passage 100*g* and enables the discharge of the cooling water into the bypass passage 100*m* via the water delivery passage 100*i* and the water delivery pipe 32. From this, it can be said that the bypass passage 100*m* is a passage through which the cooling water is circulated while bypassing the radiator 24.

Furthermore, when the second valve 22 has the rotor rotated further in the positive direction from the rotation angle "C" indicated in FIG. 2, the opening ratio for the water delivery passage 100*i* decreases from 100% to 0% and, at the same time, the opening ratio for the radiator passage 100*g* increases from 0% to 100% in a range indicated by "D" in FIG. 2. Note that the second valve 22 has an opening ratio of 100% for the heater passage 100*h* remaining unchanged in the range indicated by "D" in FIG. 2. Accordingly, in the range indicated by "D" in FIG. 2, the second valve 22 enables the discharge of the cooling water into the heater passage 100*h* and, at the same time, the discharge of the cooling water into the water delivery passage 100*i* and the radiator passage 100*g* at an intermediate opening (according to the opening ratio). In other words, in the range indicated by "D" in FIG. 2, the second valve 22 enables the adjustment of a flow rate of the cooling water to be circulated through the radiator 24 and the bypass passage 100*m* through the use of the intermediate opening.

In addition, when the second valve 22 has the rotor rotation angle indicated by "E" in FIG. 2 after the rotor is rotated further in the positive direction from the rotation angle within the range indicated by "D" in FIG. 2, the opening ratios for the heater passage 100*h* and the radiator passage 100*g* become 100%, enabling the discharge of the cooling water into the heater passage 100*h* and the radiator passage 100*g*. In other words, the rotation angle indicated by "E" in FIG. 2 disables the circulation of the cooling water through the bypass passage 100*m* and enables the circulation of the cooling water through the radiator passage 100*g* (the radiator 24), causing the cooling water to be most circulated through the radiator 24.

In contrast, when the second valve 22 has the rotor rotation angle indicated by "F" in FIG. 2 after the rotor is rotated in the negative direction, the opening ratio for the water delivery passage 100*i* becomes 100%, enabling the discharge of the cooling water into the water delivery passage 100*i* only.

In addition, when the second valve 22 has the rotor rotated further in the negative direction from the rotation angle "F" indicated in FIG. 2, the opening ratio for the water delivery passage 100*i* decreases from 100% to 0% and, at the same time, the opening ratio for the radiator passage 100*g* increases from 0% to 100% in the range indicated by "G" in FIG. 2. Accordingly, in the range indicated by "G" in FIG. 2, the second valve 22 enables the adjustment of a flow rate of cooling water to be circulated through the radiator 24 and the bypass passage 100*m* through the use of the intermediate opening.

In addition, when the second valve 22 has the rotor rotation angle indicated by "H" in FIG. 2 after the rotor is rotated further in the negative direction from the rotation angle within the range indicated by "G" in FIG. 2, the opening ratio for the radiator passage 100*g* becomes 100%, enabling the discharge of the cooling water into the radiator passage 100*g*.

As described above, the second valve 22 can determine whether the cooling water is discharged to the heater passage 100*h* based on whether the rotor is rotated in the positive or negative direction. In addition, regardless of whether the rotor is rotated in the positive or negative direction, the second valve 22 enables the adjustment of the opening ratio for the water delivery passage 100*i* and the radiator passage 100*g* through the adjustment of the rotation angle. In other words, the second valve 22 enables the adjustment of a flow rate of cooling water to be circulated through the radiator 24 and the bypass passage 100*m* through the adjustment of the rotation angle.

Next, control processing by the controller 38 will be described below. As illustrated in FIG. 1, the controller 38 functions as a valve controller 40 when performing control processing.

Based on a cooling water temperature measured by the temperature sensors T1 through T4, an engine speed, and an engine load, the valve controller 40 controls the opening and closing of the first valve 18 and the rotor rotation angle of the second valve 22.

When the temperature (hereinafter referred to as a block temperature), measured by the temperature sensor T2, of the cooling water that has run through the cylinder block 14 is lower than a predetermined second temperature threshold (for instance, 110 degrees centigrade), the valve controller 40 puts the first valve 18 in a closed state, disabling the circulation of the cooling water through the cylinder block 14. In addition, when the block temperature is equal to or higher than the second temperature threshold (for instance, 110 degrees centigrade), the valve controller 40 puts the first valve 18 in an open state, enabling the circulation of the cooling water through the cylinder block 14.

Furthermore, based on the head temperature measured by the temperature sensor T3, the valve controller 40 acquires any of a plurality of target temperature maps and, based on an engine speed and an engine load, sets a target temperature for the cooling water running through the cylinder head 16 with reference to the thus acquired target temperature map. Note that the plurality of target temperature maps have target temperatures corresponding to the engine speeds and engine loads with higher engine loads resulting in lower target temperatures and are stored in the ROM.

The valve controller 40, when setting a target temperature, determines whether the heater switch is on or off and the rotor rotation angle of the second valve 22 according to the thus set target temperature and controls the second valve 22 (or the rotor) so as to give the determined rotation angle in any of the states from "A" to "G" in FIG. 2. Note that the valve controller 40 controls the second valve 22 in such a manner as to further rotate the rotor in the positive or negative direction as the set target temperature becomes higher. In other words, the valve controller 40 performs control in such a manner as to raise the cooling water temperature by disabling the circulation of the cooling water through the radiator 24 as the target temperature becomes higher, while the valve controller 40 performs control in such a manner as to lower the cooling water temperature by enabling the circulation of the cooling water through the radiator 24 as the target temperature becomes lower.

In addition, the valve controller 40 make corrections for the rotor rotation angle of the second valve 22 based on the temperature difference between the target temperature and the head temperature. Specifically, if the temperature difference obtained by subtracting the head temperature from the target temperature is greater than 0 (zero), the valve controller 40 makes corrections so that the rotor rotation angle approaches 0 as the temperature difference becomes greater. In other words, if the head temperature is lower than the target temperature, the valve controller 40 performs control in such a manner as to disable the circulation of the cooling water through the radiator 24 and thereby raise the cooling water temperature.

Furthermore, if the temperature difference obtained by subtracting the head temperature from the target temperature is smaller than 0, the valve controller 40 makes corrections so that the rotor rotation angle moves away from 0 as the temperature difference becomes smaller. In other words, if the head temperature is higher than the target temperature, the valve controller 40 performs control in such a manner as to enable the circulation of the cooling water through the radiator 24 and thereby lower the cooling water temperature.

Furthermore, the valve controller 40 makes corrections for the rotor rotation angle of the second valve 22 based on the temperature (hereinafter also referred to as a pump temperature), measured by the temperature sensor T1, of the cooling water discharged from the water pump 10 and the temperature (hereinafter also referred to as an engine temperature), measured by the temperature sensor 14, of cooling water that has run through the engine 2. Specifically, the valve controller 40 makes corrections for the rotor rotation angle of the second valve 22 so as to minimize a delay in response to a change in water temperature if the target temperature is changed as a result of a rapid change in the engine speed and the engine load.

Next, a flow of the cooling water that is circulated through the cooling passages 100 according to an open/closed state of the first valve 18, the second valve 22, and the thermostat valve 34 will be described below. Though the valve controller 40 controls the rotor rotation angle of the second valve 22 based mainly on the engine speed and the engine load, as described above, a description based on water temperature is provided below to facilitate understanding.

FIGS. 3 through 8 are diagrams illustrating how the cooling water is circulated when the heater 26 is off. In FIGS. 3 through 8, portions of the cooling water passages 100 (100*a* through 100*m*) through which the cooling water is circulated are depicted by solid lines, portions of the cooling water passages 100 (100*a* through 100*m*) through which the cooling water is not circulated are depicted by dashed lines, and portions of the cooling water passages 100 (100*a* through 100*m*) in which the circulation of the cooling water is controlled by an intermediate opening are depicted by dashed-dotted lines.

Figure 3:
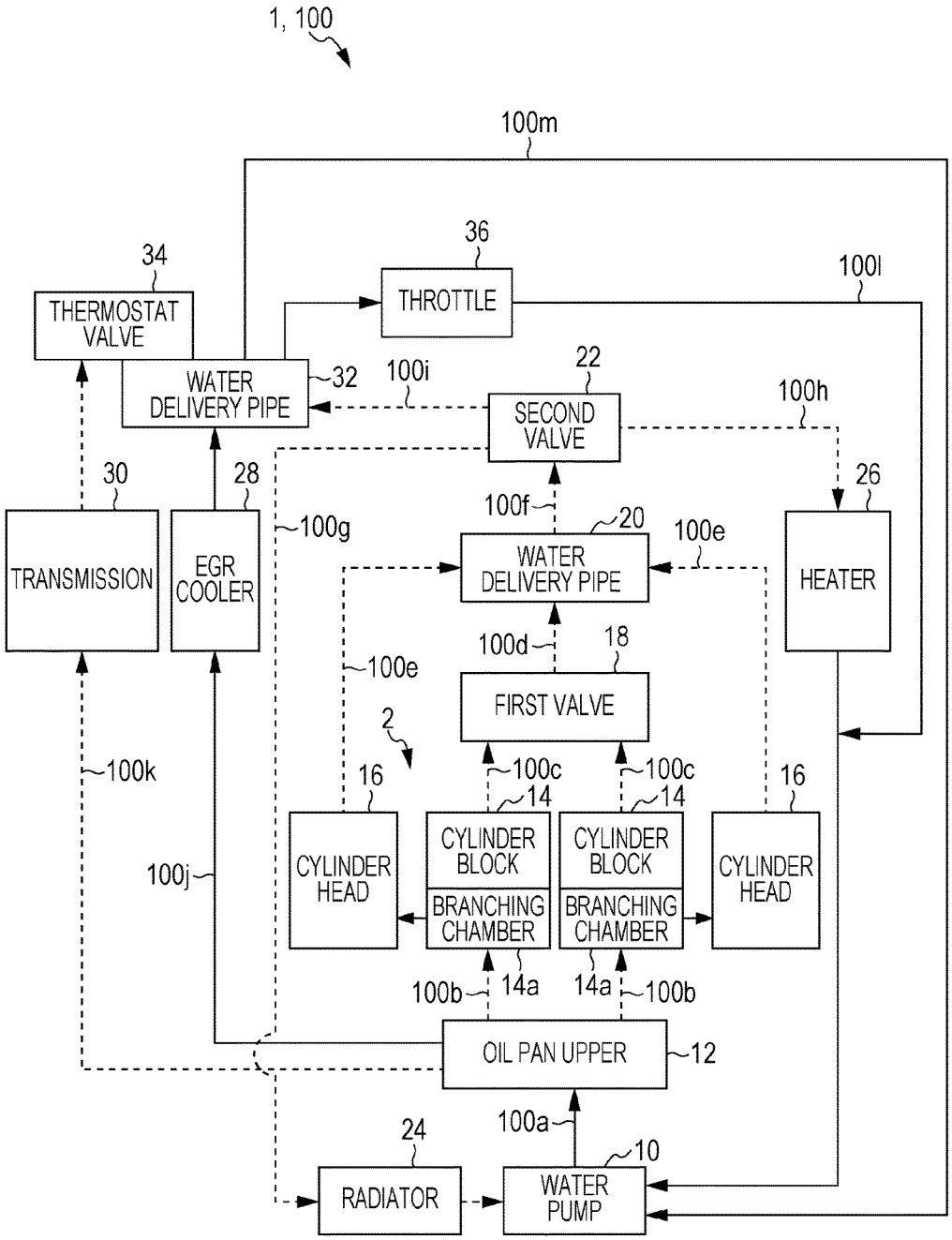
FIG. 3 is a diagram illustrating how cooling water is circulated when a heater is off.

As illustrated in FIG. 3, when the cooling water is not yet warmed up and is cold (at 50 degrees centigrade or less) immediately after the engine 2 is started up, the second valve 22 is maintained at the rotation angle indicated by "A" in FIG. 2, while the first valve 18 and the thermostat valve 34 are put in the closed state. In the vehicle 1 under this condition, the first valve 18 is put in the closed state and, at the same time, the second valve 22 has an opening ratio of 0% for each of the passages, enabling the cooling water discharged from the water pump 10 to be circulated only through the EGR passage 100*j* via the oil pan upper 12. In addition, part of the cooling water flowing into the water delivery pipe 32 is circulated through the throttle passage 100*l*, while most part of the cooling water flowing into the water delivery pipe 32 is returned to the water pump 10 via the bypass passage 100*m*.

As described above, when the cooling water is cold, the cooling water within the engine 2 and the transmission 30 is warmed as early as possible through the limitation of portions of the cooling passages 100 through which the cooling water is circulated, thereby raising the oil temperature of the engine 2 to reduce oil friction as early as possible.

Figure 4:
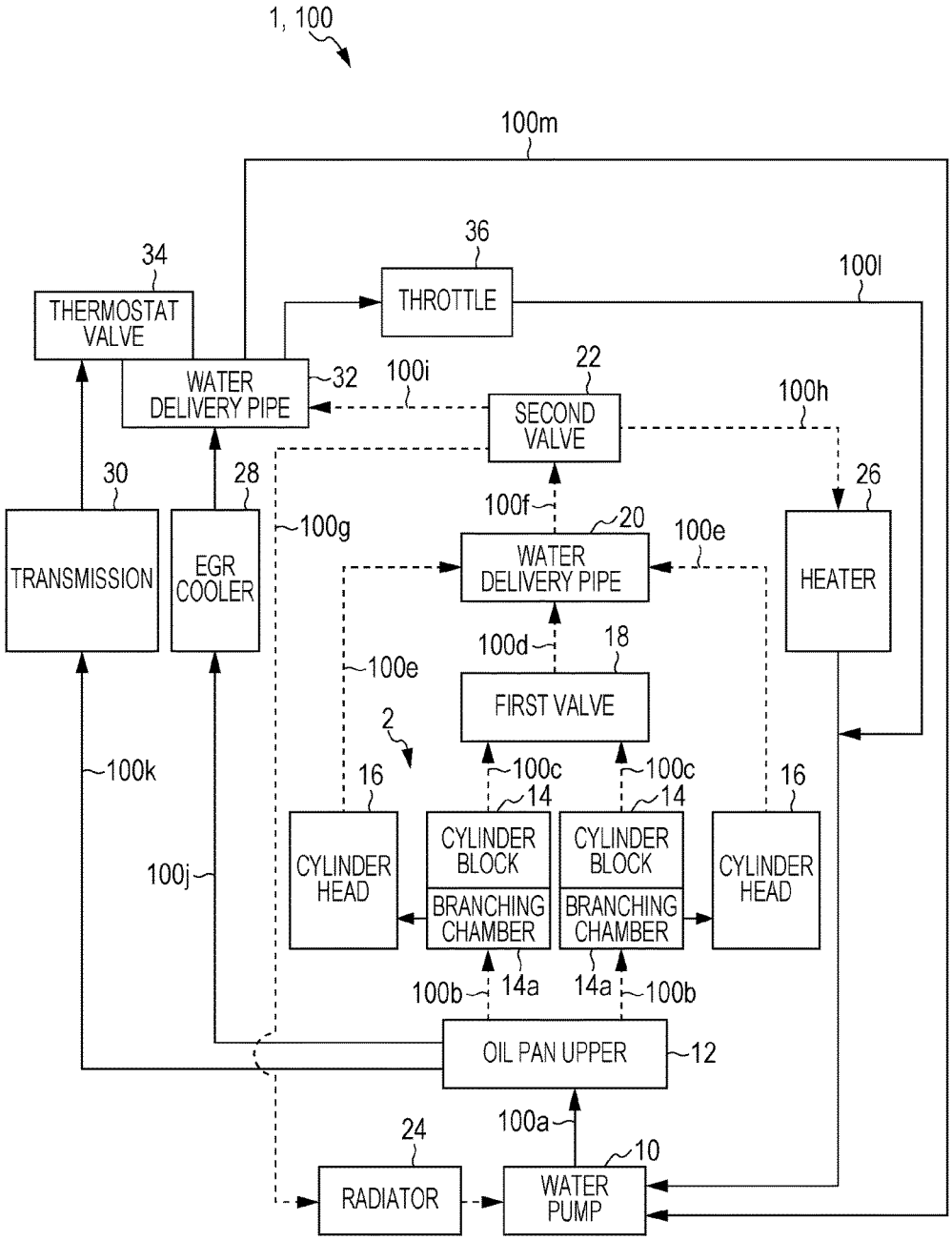
FIG. 4 is a diagram illustrating how cooling water is circulated when a heater is off.

When the temperature of cooling water within the water delivery pipe 32 exceeds a predetermined first temperature threshold (50 degrees centigrade), the thermostat valve 34 is put into the open state in the vehicle 1 as illustrated in FIG. 4, which enables the circulation of cooling water through the transmission passage 100, thereby raising the fluid temperature of the transmission 30 to reduce fluid friction as early as possible.

Figure 5:
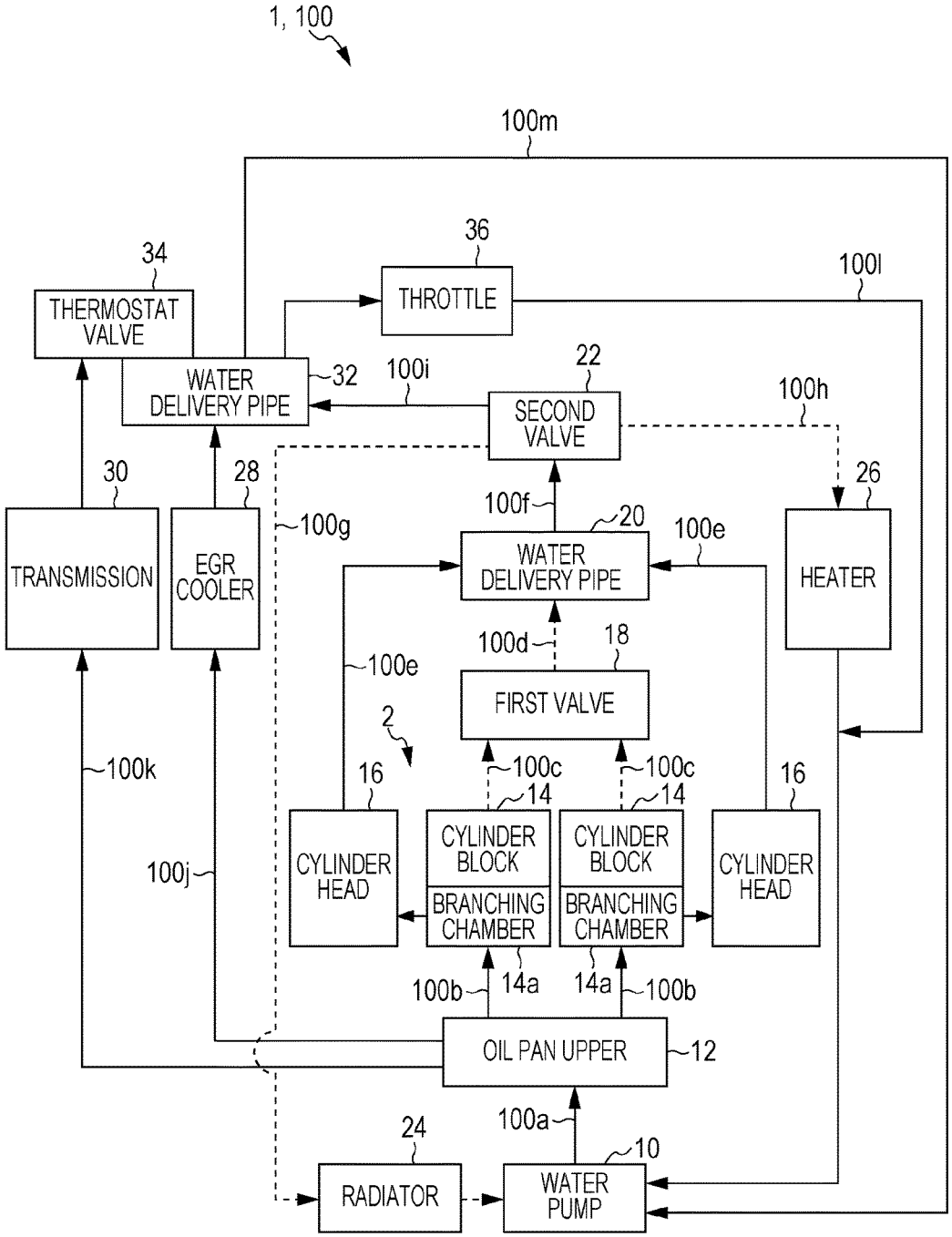
FIG. 5 is a diagram illustrating how cooling water is circulated when a heater is off.

In addition, when the head temperature rises and the second valve 22 is maintained at the rotation angle indicated by "F" in FIG. 2 with an opening ratio of 100% for the water delivery passage 100*i*, the cooling water begins to be circulated through the water delivery pipe 32 from the second valve 22 in the vehicle 1, as illustrated in FIG. 5. This causes the cooling water to be circulated through the cylinder head 16 from the oil pan upper 12 via the branching chamber 14*a*. As a result, the cylinder head 16 is cooled by the cooling water. Note that the cylinder head 16 has greater heat receiving and smaller heat capacity than the cylinder block 14 and accordingly rises in temperature more easily. This is the reason why the cooling water is circulated through the cylinder head 16 first independently of the cylinder block 14.

Figure 6:
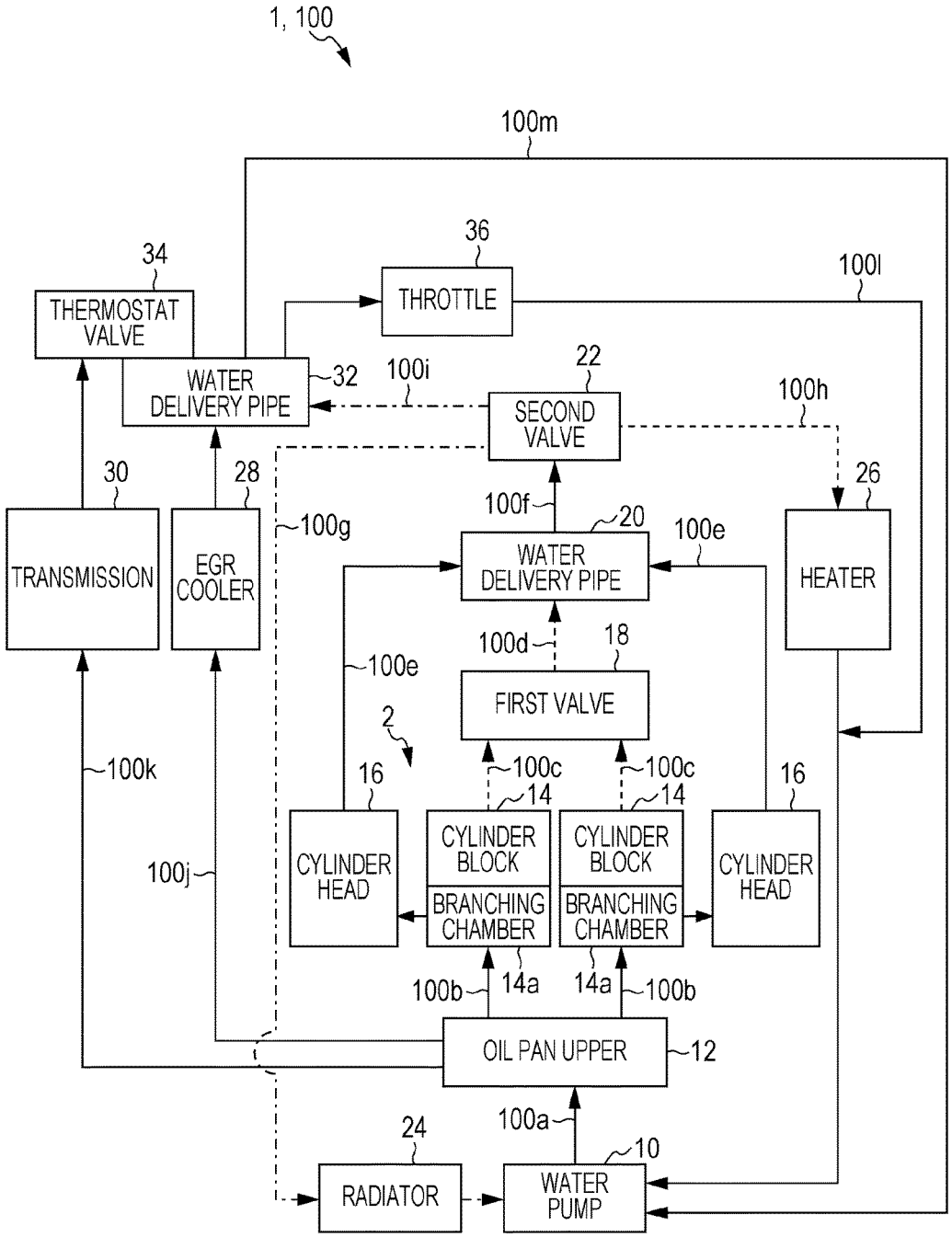
FIG. 6 is a diagram illustrating how cooling water is circulated when a heater is off.

Subsequently, when the cooling water temperature further rises and the second valve 22 is controlled at a rotation angle falling within the range indicated by "G" in FIG. 2 with an opening ratio being an intermediate opening for the water delivery passage 100*i* and the radiator passage 100*g*, part of cooling water that has been circulated through the cylinder head 16 is also circulated through the radiator 24 in the vehicle 1, as illustrated in FIG. 6. When being circulated through the radiator 24, the cooling water is cooled by the radiator 24. At this time, the opening ratio for the water delivery passage 100*i* and the radiator passage 100*g* enables an adjustment of the flow rate of the cooling water flowing into the radiator 24, which also enables an adjustment of the amount of the cooling water to be cooled.

Figure 7:
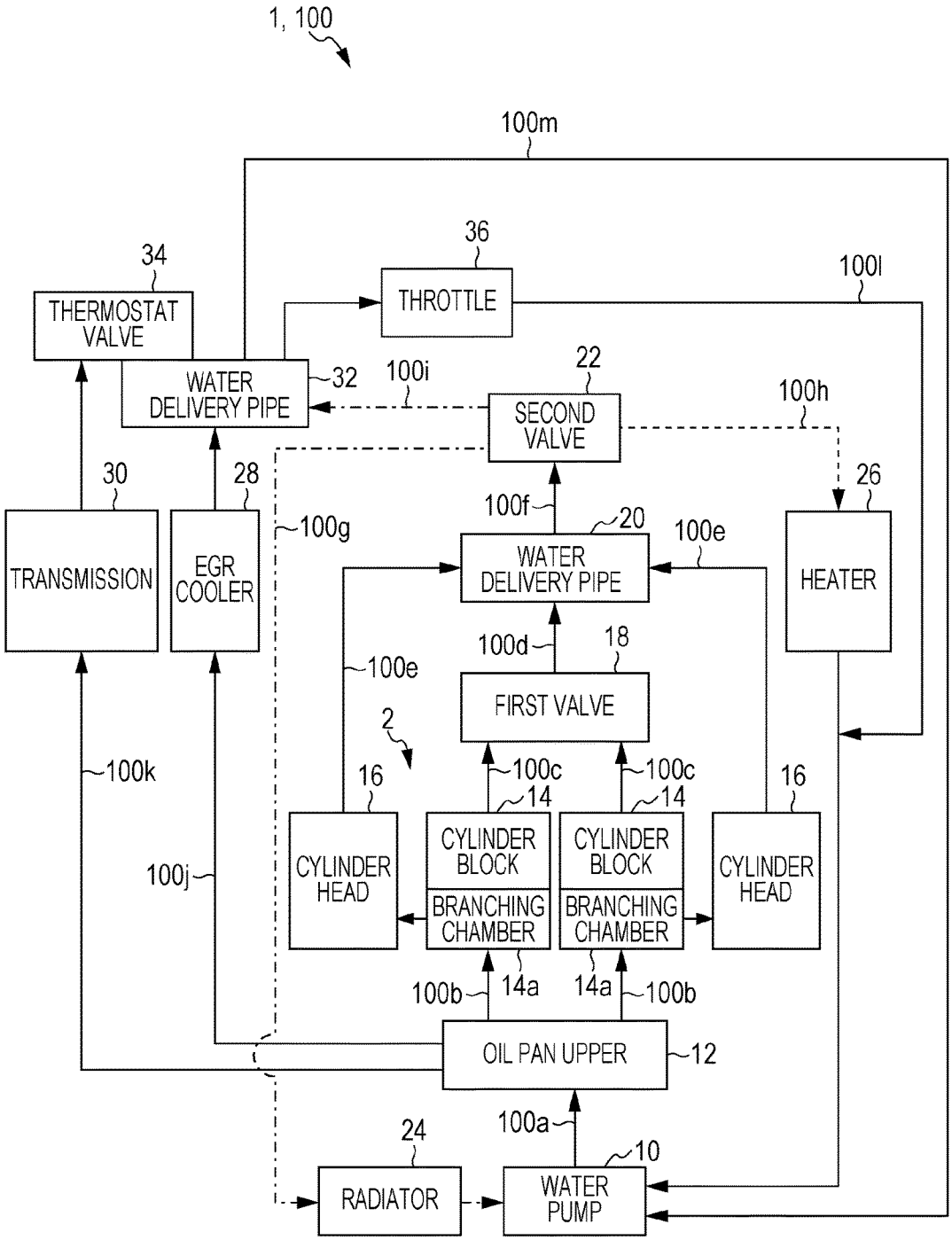
FIG. 7 is a diagram illustrating how cooling water is circulated when a heater is off.

In addition, when the block temperature exceeds a second temperature threshold, the first valve 18 is put into the open state, enabling the circulation of the cooling water through the cylinder block 14 in the engine 1, as illustrated in FIG. 7. The cooling water circulated through the cylinder block 14 cools and maintains the cylinder block 14 at a proper temperature.

Figure 8:
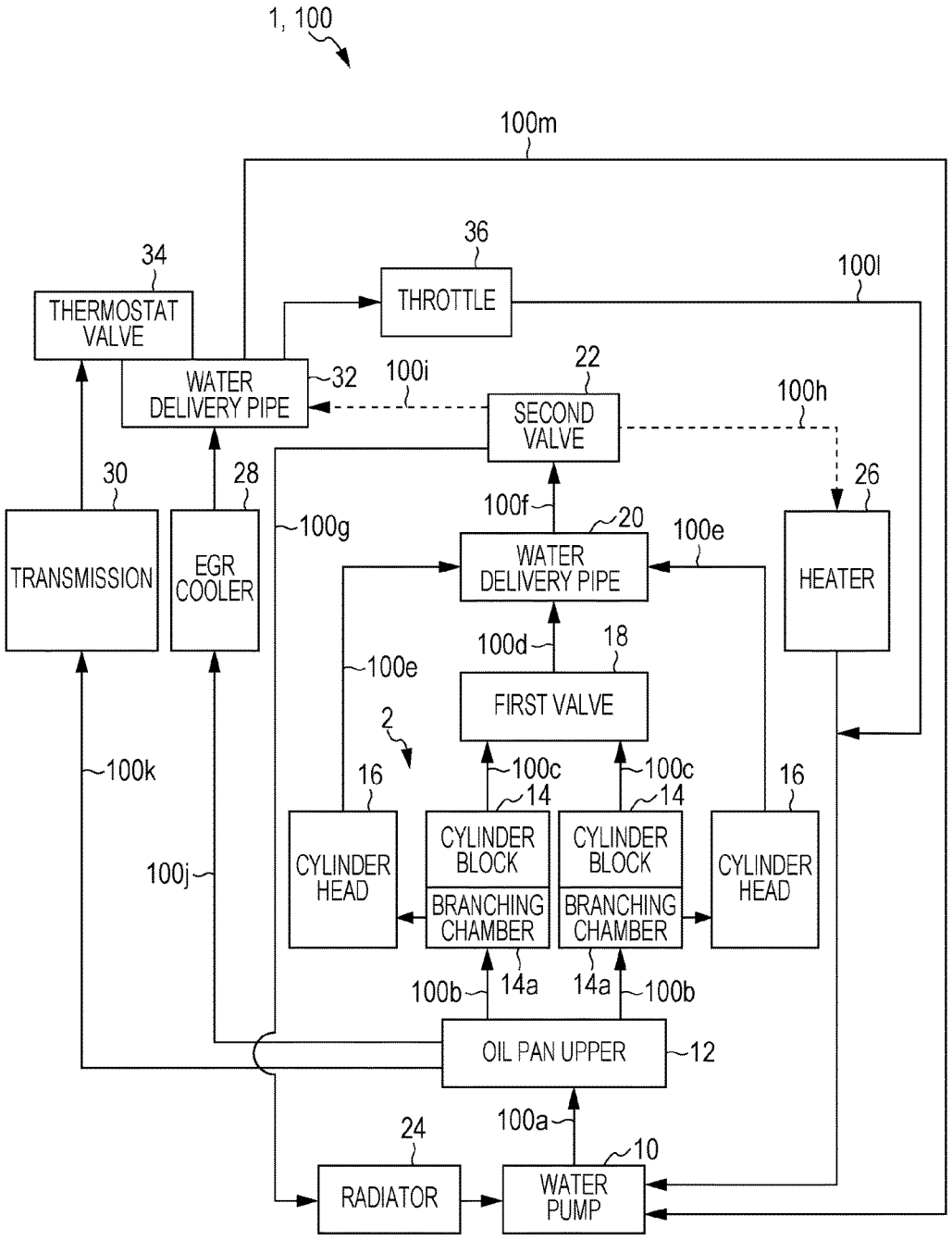
FIG. 8 is a diagram illustrating how cooling water is circulated when a heater is off.

When the cooling water temperature rises most due to increased engine load, the second valve 22 is maintained at the rotation angle indicated by "H" in FIG. 2 with an opening ratio of 100% for the radiator passage 100*g*. In the vehicle 1 under this condition, most of cooling water that has been circulated through the engine 2 begins to be circulated through the radiator 24 where the cooling water is cooled at a maximum, as illustrated in FIG. 8.

FIGS. 9 through 13 are diagrams illustrating how the cooling water is circulated when the heater 26 is on. In FIGS. 9 through 13, portions of the cooling water passages 100 through which the cooling water is circulated are depicted by solid lines, portions of the cooling water passages 100 through which the cooling water is not circulated are depicted by dashed lines, and portions of the cooling water passages 100 in which the circulation of the cooling water is controlled by an intermediate opening are depicted by dashed-dotted lines.

When the cooling water is not yet warmed up and is cold immediately after the engine 2 is started up, the second valve 22 is maintained at the rotation angle indicated by "A" in FIG. 2 and the first valve 18 and the thermostat valve 34 are put in the closed state, even if the heater 26 is in the on position. In the vehicle 1 under this condition, no cooling water is circulated through the heater 26 as is the case for the heater 26 in the off position illustrated in FIGS. 3 and 4.

Figure 9:
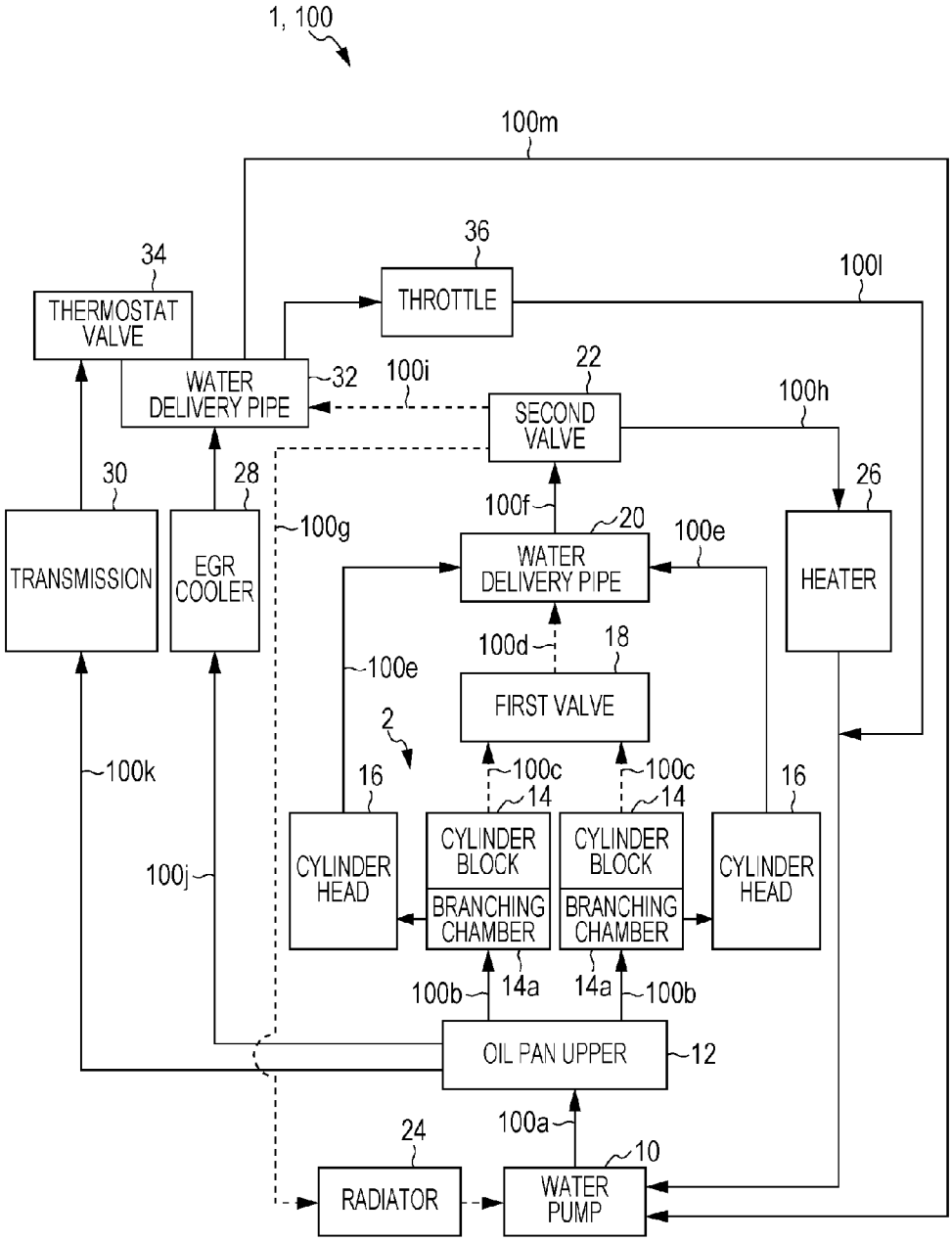

Subsequently, when the head temperature rises to, for instance, 50 degrees centigrade, the second valve 22 is maintained at the rotation angle indicated by "B" in FIG. 2 with an opening ratio of 100% for the heater passage 100*h*. In the vehicle 2 under this condition, the cooling water begins to be circulated through the heater passage 100*h* from the second valve 22, as illustrated in FIG. 9, thereby enabling the heater 26 to use heat released from the cooling water to heat the passenger compartment.

Figure 10:
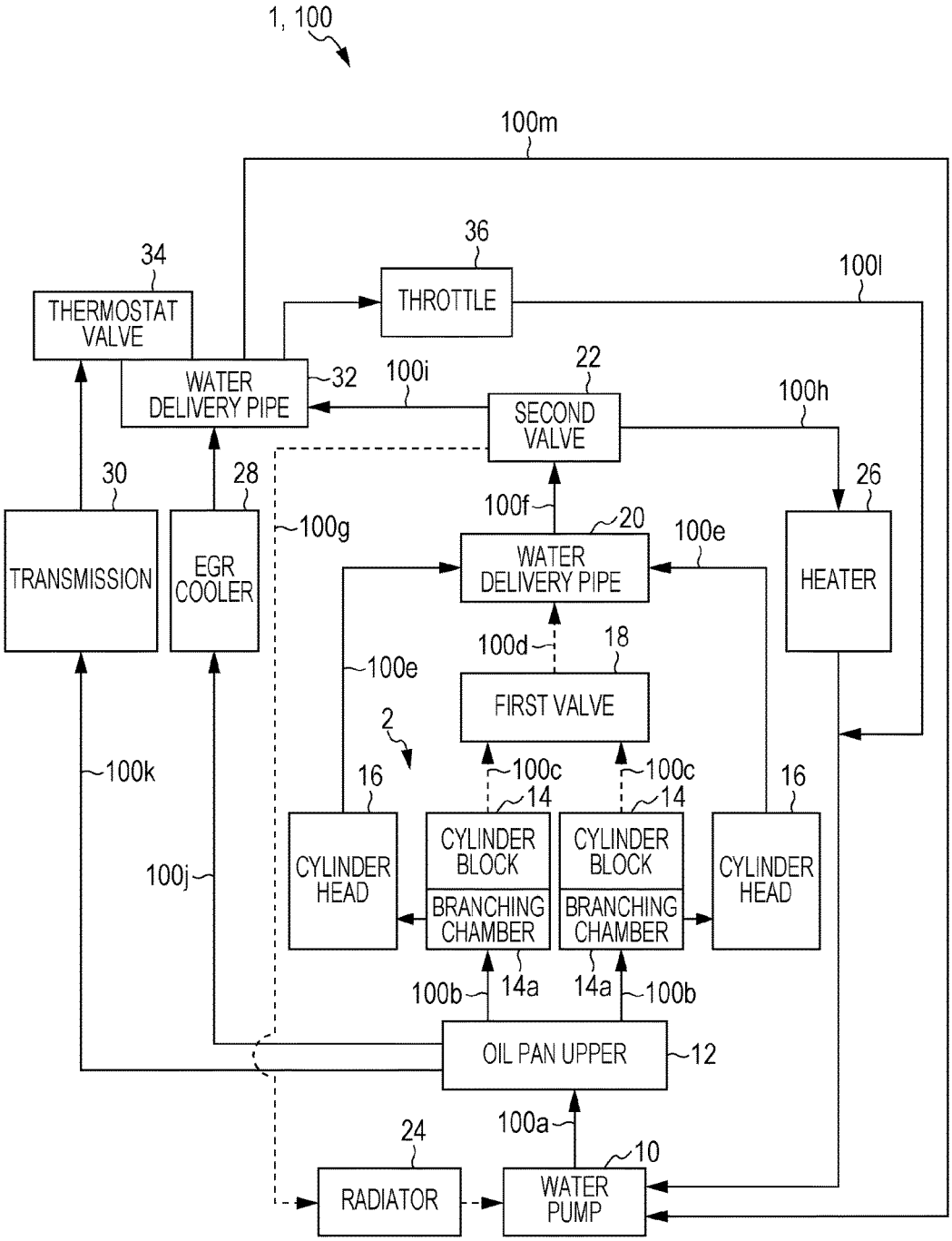
Figure 11:
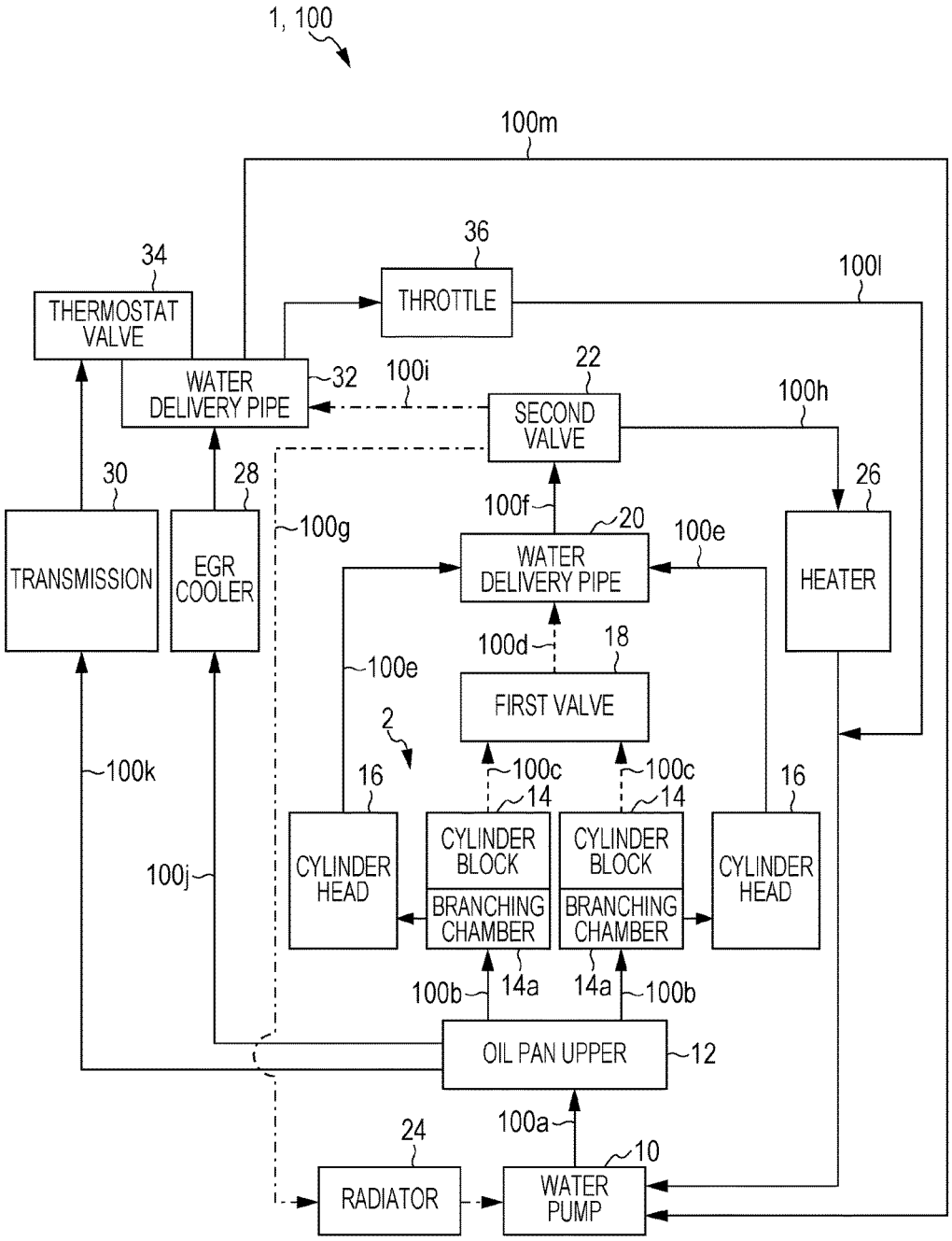

In addition, when the head temperature rises higher, the second valve 22 is maintained at the rotation angle indicated by "C" in FIG. 2 with an opening ratio of 100% for the water delivery pipe 32 and the heater passage 100*h*. In the vehicle 1 under this condition, the cooling water begins to be circulated through the water delivery pipe 32 and the heater passage 100*h* from the second valve 22, as illustrated in FIG. 10.

Subsequently, when the head temperature further rises, the second valve 22 is controlled at a rotation angle falling within the range indicated by "D" in FIG. 2, while the opening ratio becomes the intermediate opening for the water delivery passage 100*i* and the radiator passage 100*g* and 100% for the heater passage 100*h*. In the vehicle 100 under this condition, the cooling water begins to be circulated through the heater passage 100*h* and, at the same time, part of the cooling water that has been circulated through the cylinder head 16 also begins to be circulated through the radiator 24.

Figure 12:
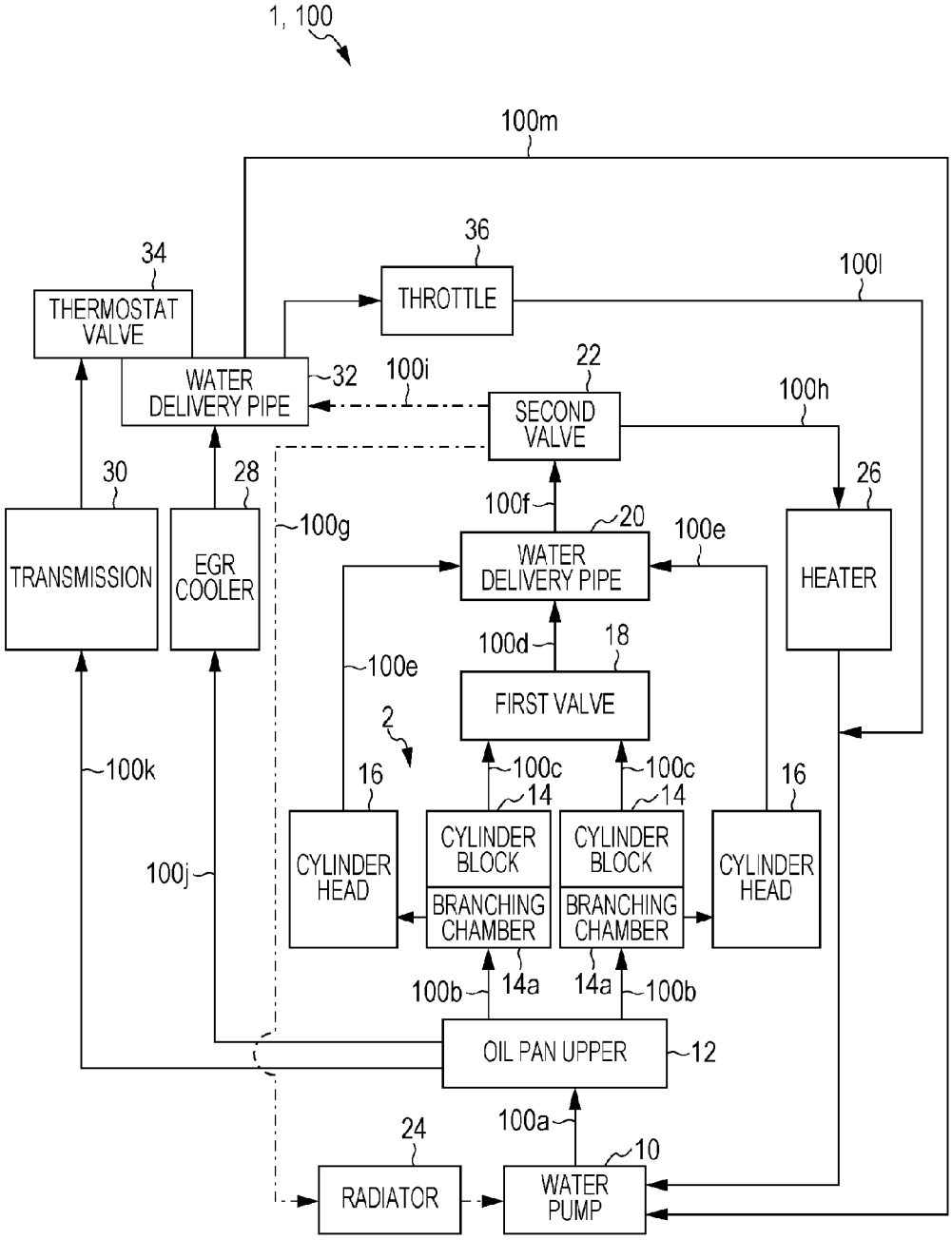

When the block temperature rises higher than a second temperature threshold and the first valve 18 is put into the open state, the cooling water also begins to be circulated through the cylinder block 14, as illustrated in FIG. 12. In the vehicle 1 under this condition, the cooling water circulated through the cylinder block 14 cools and maintains the cylinder block 14 at a proper temperature.

Figure 13:
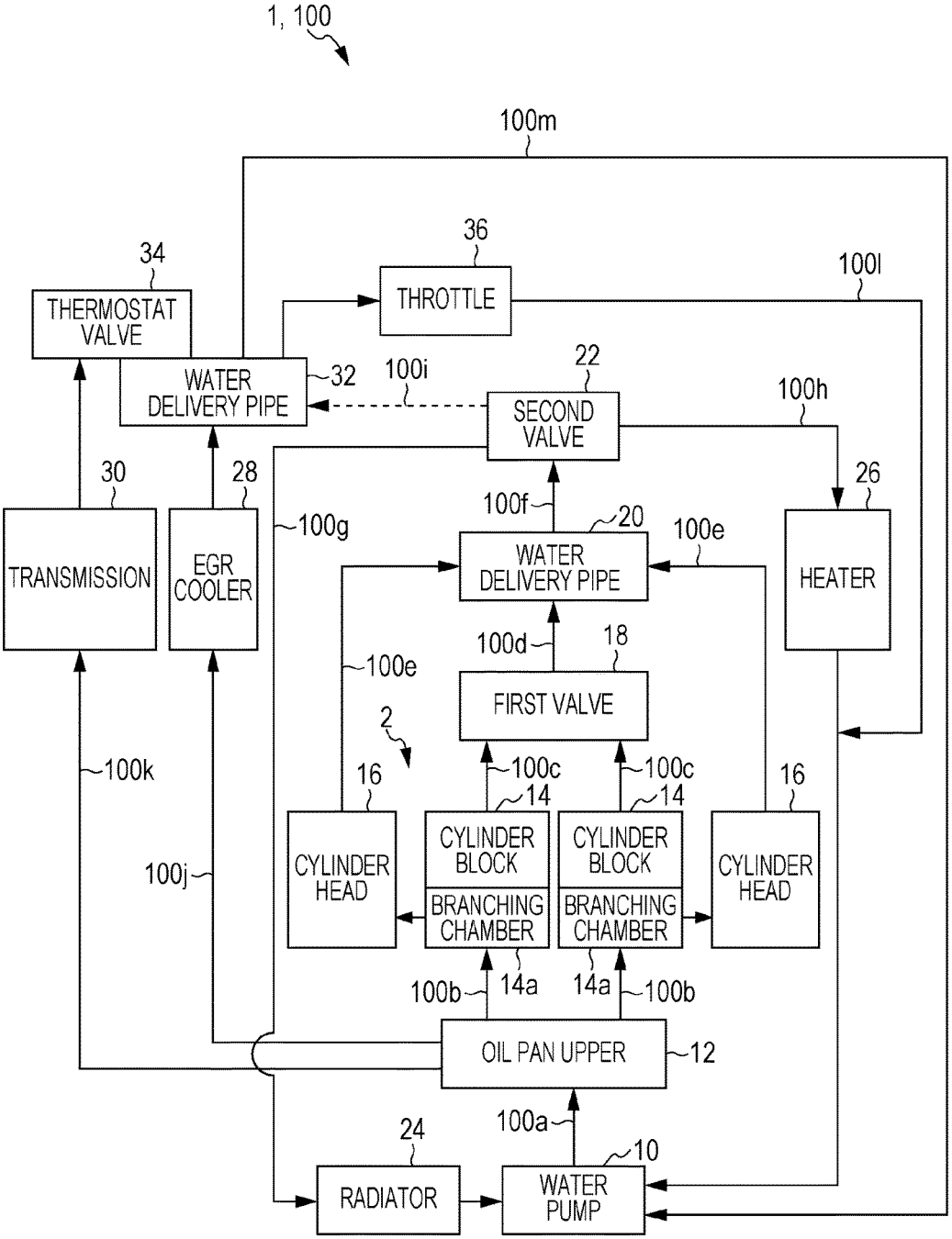

When the engine load increases and, as a result, the cooling water temperature rises most, the second valve 22 is maintained at the rotation angle indicated by "E" in FIG. 2 with an opening ratio of 100% for the radiator passage 100*g* and the heater passage 100*h*. In the vehicle 1 under this condition, the cooling water that has been circulated through the engine 2 begins to be circulated through the heater passage 100*h* and the radiator 24 where the cooling water is cooled at a maximum, as illustrated in FIG. 13.

As described above, the vehicle 1 enables the cooling water to be circulated therethrough independently of the cylinder block 14 and the cylinder head 16, in which the first valve 18 determines whether the cooling water is circulated through the cylinder block 14. In addition, the vehicle 1 is provided with the second valve 22 that receives the cooling water that has been circulated through the engine 2 (the cylinder block 14 and the cylinder head 16) and which controls entry of the cooling water into the radiator passage 100*g* and the bypass passage 100*m* through the use of an intermediate opening.

Accordingly, the vehicle 1 causes the cooling water to be circulated through at least one of the radiator passage 100*g* and the bypass passage 100*m* by controlling the second valve 22, thereby enabling the cooling water to be circulated through the cylinder head 16. In addition, the vehicle 1 adjusts the opening ratio for the radiator passage 100*g* by controlling the second valve 22, thereby enabling the adjustment of the amount of cooling water to be cooled. Accordingly, the vehicle 1 can control the increasing and decreasing of cooling water temperature as early as possible according to the operating conditions of the engine 2, thereby enabling effective warming-up and cooling of various components (including the cylinder block 14, the cylinder head 16, the EGR cooler 28, the heater 26, the transmission 30, and the like) of the vehicle 1.

Furthermore, the transmission 30 is configured to have cooling water circulated therethrough independently of the engine 2. With this arrangement, when the temperature of cooling water within the water delivery pipe 32 exceeds a first temperature threshold, the cooling water begins to be circulated through the transmission 30, thereby enabling the warming-up and cooling of the transmission 30 independently of the engine 2.

The present invention is typically described above with reference to, but not limited to, the foregoing example by referring the attached drawing. Various modifications are conceivable within the scope of the present invention.

Although the CVT is described above as the transmission 30 in the above example, the transmission 30 is not limited to the CVT and may include a stepped transmission.

The invention claimed is:

1. A vehicle comprising:

a radiator through which cooling water is able to be circulated independently of a cylinder block and a cylinder head, the radiator being configured to cool the cooling water;

a bypass passage through which the cooling water is able to be circulated in such a manner as to bypass the radiator;

a first valve that is switchable between an open state in which the cooling water is circulated through the cylinder block and a closed state in which the cooling water is not circulated through the cylinder block;

a second valve that is configured to receive the cooling water that has been circulated through the cylinder head and the cooling water that has been circulated through the cylinder block via the first valve, and that, through the use of an intermediate opening, is capable of adjusting a flow rate of the cooling water that is to be circulated through the radiator and the bypass passage; and a controller that is configured to control opening and closing of the first valve and an opening of the second valve, wherein the controller is controller to control the opening of the second valve based on an engine speed, an engine load, and a temperature of cooling water that has been circulated through the cylinder head, wherein the controller is configured to correct the opening of the second valve based on a temperature of the cooling water that has been circulated through the cylinder block and a temperature of the cooling water that has been discharged from a water pump, the vehicle further comprising:

a first temperature sensor disposed between the water pump and the engine configured to measure a first temperature; and a second temperature sensor disposed on a downstream side of the engine configured to measure a second temperature, and wherein the controller is configured to correct the opening of the second valve with the first temperature and the second temperature.

2. The vehicle according to claim 1, further comprising a thermostat valve that is switchable between an open state in which the cooling water is circulated through a transmission independently of the cylinder block and the cylinder head and a closed state in which the cooling water is not circulated through the transmission.

3. The vehicle according to claim 2, further comprising a water delivery pipe through which the cooling water that has been circulated from the second valve and the cooling water that has been circulated from the transmission via the thermostat are able to be discharged into the bypass passage.

4. The vehicle according to claim 1, further comprising:

a water pump that is rotated by rotary power of an engine of the vehicle; and an oil pan upper that temporarily holds the cooling water received from the water pump via a pump discharge passage and discharges the cooling water to the cylinder block and the cylinder head, wherein the first valve has a block discharge passage and the valve passage coupled thereto downstream of the oil pan upper and is switchable between the open state in which the block discharge passage and the valve passage are in communication with each other and a closed state in which the block discharge passage and the valve passage are disconnected from each other, wherein the first valve, when in the open state, enables the cooling water received from the block discharge passage to be discharged into the valve passage, and wherein the first valve, when in the closed state, shuts off the cooling water received from the block discharge passage, disabling the discharge of the cooling water into the valve passage.

5. A vehicle comprising:

a radiator through which cooling water is able to be circulated independently of a cylinder block and a cylinder head, the radiator being configured to cool the cooling water;

a bypass passage through which the cooling water is able to be circulated in such a manner as to bypass the radiator;

a first valve that is switchable between an open state in which the cooling water is circulated through the cylinder block and a closed state in which the cooling water is not circulated through the cylinder block;

a second valve that is configured to receive the cooling water that has been circulated through the cylinder head and the cooling water that has been circulated through the cylinder block via the first valve, and that, through the use of an intermediate opening, is capable of adjusting a flow rate of the cooling water that is to be circulated through the radiator and the bypass passage;

a first water delivery pipe disposed between the first valve and the second valve that has a head passage, a valve passage, and a second valve inflowing passage coupled thereto, the first water delivery pipe receives the cooling water from the cylinder block and the cylinder head via the head passage when the first valve is in the closed state and receives the cooling water via the valve passage when the first valve is in the open state and discharges the cooling water received from the valve passage or the head passage into the second valve inflowing passage to the second valve; and a controller that is configured to control opening and closing of the first valve and an opening of the second valve.

6. The vehicle according to claim 5, wherein the second valve includes a rotor that is rotatable in a positive direction and a negative direction for a state in which a rotor rotation angle is 0 degrees to adjust the flow rate of the cooling water.

7. The vehicle according to claim 6, wherein when the second valve has the rotor rotation angle of 0 degrees, each opening ratio for a radiator passage transmitting the cooling water to the radiator, a heater passage transmitting the cooling water to a heater, and a water delivery passage transmitting the cooling water to the bypass passage is 0%, disabling discharge of the cooling water into each of the radiator passage, the heater passage, and the water delivery passage.

8. The vehicle according to claim 7, wherein, when the second valve has a rotor rotation angle after the rotor is rotated in the positive direction, the opening ratio for the heater passage becomes 100%, enabling a maximum flow of discharge of the cooling water into the heater passage only.

9. The vehicle according to claim 8, wherein, then the second valve has a third rotor rotation angle after the rotor is rotated further in the positive direction from the second rotor rotation angle, opening ratios for the heater passage and the water delivery passage become 100%, enabling the discharge of the cooling water into the heater passage and the water delivery passage thereby circulating the cooling water while bypassing the radiator.

10. The vehicle according to claim 5, further comprising:

a second water delivery pipe that receives the cooling water that has been circulated from the second valve via a water delivery passage and is connected downstream of the bypass passage; and a heater that receives the cooling water that has been circulated from the second valve via a heater passage, wherein the controller determines whether the second valve discharges the cooling water to the heater passage, the water delivery passage, and a radiator passage connected to the radiator based on whether the rotor is rotated in the positive or negative direction.

11. A vehicle comprising:

a radiator through which cooling water is able to be circulated independently of a cylinder block and a cylinder head, the radiator being configured to cool the cooling water;

a bypass passage through which the cooling water is able to be circulated in such a manner as to bypass the radiator;

a first valve that is switchable between an open state in which the cooling water is circulated through the cylinder block and a closed state in which the cooling water is not circulated through the cylinder block;

a second valve that is configured to receive the cooling water that has been circulated through the cylinder head and the cooling water that has been circulated through the cylinder block via the first valve, and that, through the use of an intermediate opening, is capable of adjusting a flow rate of the cooling water that is to be circulated through the radiator and the bypass passage;

a controller that is configured to control opening and closing of the first valve and an opening of the second valve;

a thermostat valve that is switchable between an open state in which the cooling water is circulated through a transmission independently of the cylinder block and the cylinder head and a closed state in which the cooling water is not circulated through the transmission; and a water delivery pipe through which the cooling water that has been circulated from the second valve and the cooling water that has been circulated from the transmission via the thermostat are able to be discharged into the bypass passage.

* * * * *